US006189653B1

(12) United States Patent
Laug

(10) Patent No.: US 6,189,653 B1
(45) Date of Patent: Feb. 20, 2001

(54) MULTI-PURPOSE SCAFFOLD

(76) Inventor: Horst Laug, Haselünner Strasse 72, D-49809 Lingen (DE)

( * ) Notice: Under 35 U.S.C. 154(b), the term of this patent shall be extended for 0 days.

(21) Appl. No.: 09/416,024

(22) Filed: Oct. 8, 1999

Related U.S. Application Data

(63) Continuation of application No. PCT/DE98/00793, filed on Mar. 18, 1998.

(30) Foreign Application Priority Data

Apr. 8, 1997 (DE) ..... 197 14 431.4

(51) Int. Cl.[7] ..... E04G 1/34; E06C 1/00
(52) U.S. Cl. ..... 182/152; 182/200
(58) Field of Search ..... 182/200, 27, 25, 182/161, 172, 152

(56) References Cited

U.S. PATENT DOCUMENTS 2,220,155 * 11/1940 Jachim ..... 182/106 X
2,261,479 * 11/1941 Moen ..... 182/172
3,259,207 * 7/1966 Schoeffler ..... 182/161 X
4,030,255 * 6/1977 Hartman ..... 182/106 X
4,565,262 * 1/1986 Hawkins ..... 182/200 X
4,574,937 * 3/1986 Anderson et al. ..... 182/106 X
5,462,133 * 10/1995 Merrill, Jr. ..... 182/172

* cited by examiner

*Primary Examiner*—Daniel P. Stodola
*Assistant Examiner*—Hugh B. Thompson
(74) *Attorney, Agent, or Firm*—Herbert L. Lerner; Laurence A. Greenberg; Werner H. Stemer

(57) ABSTRACT

A multi-purpose scaffold includes rail parts disposed adjacent one another and displaceable relative to one another, displaceable and adjustable steps disposed therebetween, fold-out splayed supporting poles connected to the rail parts, a connecting rod connected to the supporting poles for securing the supporting poles, and a locking device for releasably locking the two rail parts. The support and connection bars can be adjustably telescopic and folded parallel to the multipurpose support beams or rail parts. The support bars can have footboards or caster rollers. The walking surface is made from a line of steps that provide a flat surface when folded. One side of the steps is rotatably connected to one rail part and the other side of the steps is rotatably connected to the other rail part. The scaffold can include a climb-through aperture and one or more railings as an anti-falling safety device. The scaffold can include an extension section for connecting one scaffold to another scaffold. The scaffold can also have a telescopic rail fixed at an end transverse to a movement direction of the scaffold as an anti-tilting safety device when using the scaffold as a freely resting plank.

20 Claims, 2 Drawing Sheets

MULTI-PURPOSE SCAFFOLD

CROSS-REFERENCE TO RELATED APPLICATION:

This application is a continuation of copending International Application No. PCT/DE98/00793, filed Mar. 18, 1998, which designated the United States.

BACKGROUND OF THE INVENTION

Field of the Invention

The invention lies in the field of scaffolding. The invention relates to a multi-purpose scaffold, having two rail parts disposed adjacent one another and displaceable relative to one another, between which steps or ladder rungs are disposed for folding out at an adjustable step angle. The multi-purpose scaffold also has fold-out splayed supporting poles that can be secured by connecting rods.

A generic scaffold has been disclosed by U.S. Pat. No. 4,004,652 to Laboy-Alvarado. In the prior art scaffold, however, a relatively large standing space is necessary for the two lateral ladder elements. Belgium Publication No. 829 490 A discloses a ladder with foldout stair steps, the stair steps also being foldable to form a flat surface.

In both prior art devices, a flat standing surface is necessary for the ladder rail parts and the steps automatically adjust to be parallel to the standing surface.

SUMMARY OF THE INVENTION

It is accordingly an object of the invention to provide a multi-purpose scaffold that overcomes the hereinaforementioned disadvantages of the heretofore-known devices of this general type and that improves a scaffold so that the step angle can be predetermined regardless of the available standing or lying surface.

With the foregoing and other objects in view, there is provided, in accordance with the invention, a multi-purpose scaffold, including two rail parts disposed adjacent to one another and displaceable relative to one another, displaceable steps adjustable along a step angle and disposed between the two rail parts, at least two fold-out splayed supporting poles connected to the two rail parts, at least one connecting rod connected to the at least two supporting poles for securing the at least two supporting poles, and a locking device for releasably locking the steps along the step angle and the two rail parts.

The multi-purpose scaffold according to the invention provides a universal aid to assembly, enabling a plurality of different climbing appliances and platforms to be combined in a single appliance. One possible use for the scaffold of the invention is as a freely resting catwalk with a substantially flat movement surface, the catwalk being secured against tilting by rails that can be pushed out laterally transversely to the direction of scaffold movement. The catwalk can also be equipped with an adjustable and foldable railing.

Another possible use is as a freestanding working platform, which can also be walked on at a gradient. Adjustable steps that can be fixed at any inclination allow access to the platform, the adjustment being made from the top of the scaffold. Telescopic supports insure adaptation to any standing surface contour. Extensible and retractable climb-through apertures at the end of the platform permit safe access to the scaffold movement surface.

A third possible use is as a supported staircase. The staircase can be fixed at any desired angle of support and inclination. The step inclination can be set and locked from the top of the staircase or from the movement side. The steps can also be folded in completely in any supported position of the staircase and locked so as to form a transport slide or ascending ramp for materials, for example.

Another possible use includes a configuration as a freestanding double stepladder with individually adjustable supports. The adjustable supports allow any support angle to be set by the user. The steps also can be adjusted and locked separately at any desired inclination regardless of the support angle from the top or the movement side.

In accordance with another feature of the invention, each of the at least two supporting poles have lower ends and there is provided at least two rollers and/or pivotable footboards connected to a respective one of the lower ends of the at least two supporting poles.

In accordance with a further feature of the invention, each of the at least two supporting poles and/or the at least one connecting rod are adjustably telescopic.

In accordance with an added feature of the invention, the at least two supporting poles and/or at least one connecting rod can adjustably fold in and out from the two rail parts and can be releasably locked into a plurality of positions.

In accordance with an additional feature of the invention, there is provided an extensible, folding and removable climb-through aperture.

In accordance with yet another feature of the invention, there is provided at least one removable railing attached to at least one of the two rail parts as an anti-falling safety device.

In accordance with yet an added feature of the invention, the removable railings are foldable and/or extensible.

In accordance with yet an additional feature of the invention, each of the two rail parts has a lower end and an upper end forming a pair of lower ends and a pair of upper ends and there is provided extension sections and one of the group including adjustable suspension apparatuses, anti-slip devices, running rollers and castors and jacket tubes for receiving the extension sections to connect at least one of the pair of lower ends and the pair of upper ends to a second multi-purpose scaffold.

In accordance with again another feature of the invention, each of the two rail parts has a lower end and an upper end forming a pair of lower ends and a pair of upper ends and there is provided a telescopic rail fixed transverse to a movement direction of the scaffold to at least one of the pair of lower ends and the pair of upper ends as an anti-tilting safety device for using the scaffold as a freely resting plank.

In accordance with again a further feature of the invention, each of the two rail parts has a lower end and an upper end forming a pair of lower ends and a pair of upper ends and there is provided two telescopic rails respectively fixed transverse to a movement direction of the scaffold to the pair of lower ends and the pair of upper ends as an anti-tilting safety device for using the scaffold as a freely resting plank.

In accordance with again an added feature of the invention, the telescopic rail has two telescopic ends.

In accordance with a concomitant feature of the invention, each of the two telescopic ends has a castor.

Other features that are considered as characteristic for the invention are set forth in the appended claims.

Although the invention is illustrated and described herein as embodied in a multi-purpose scaffold, it is nevertheless not intended to be limited to the details shown, because various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
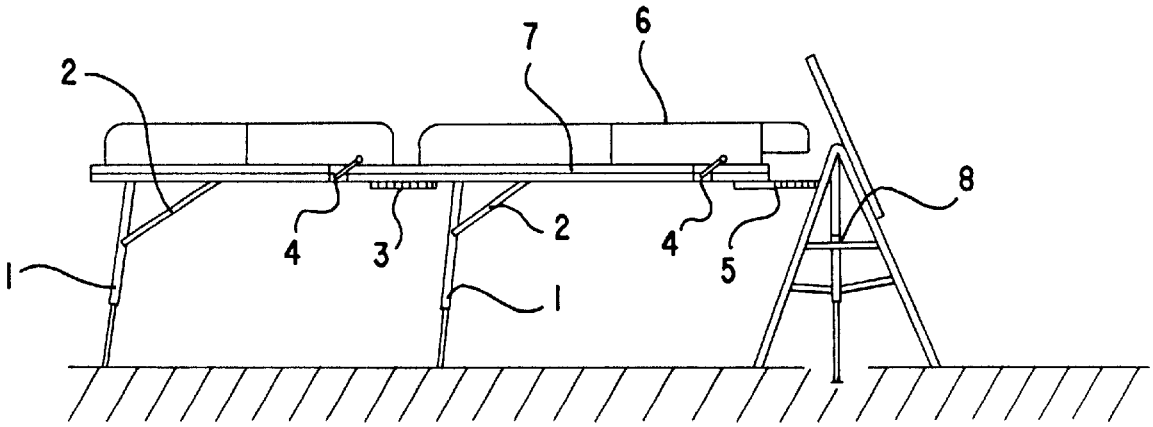
FIG. 1 is a diagrammatic, side elevational view of two multi-purpose scaffolds of the invention connected together as a platform and laid on a multi-purpose ladder secured by stabilizers.

In all the figures of the drawing, sub-features and integral parts that correspond to one another bear the same reference symbol in each case.

Figure 3:
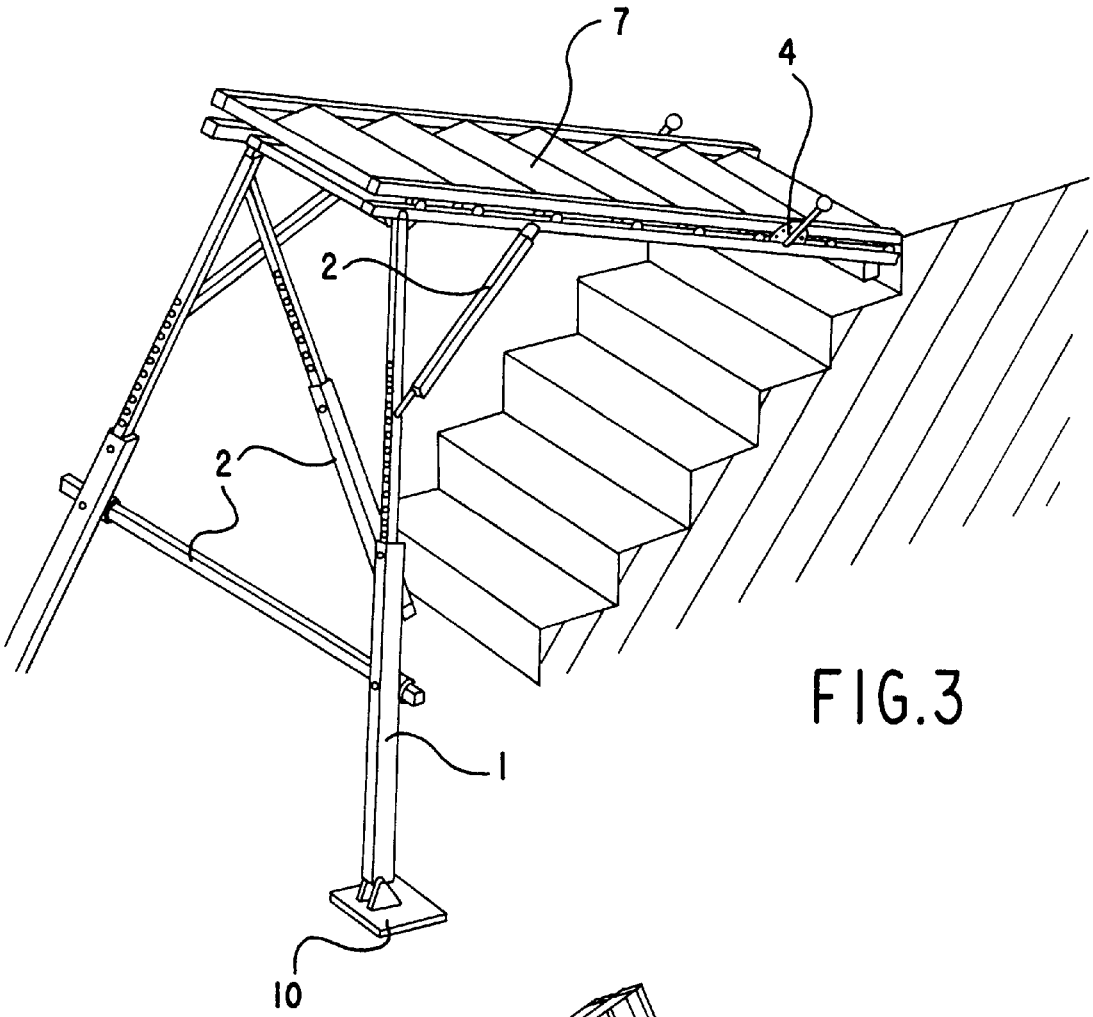
FIG. 3 is a fragmentary perspective view of a multi-purpose scaffold of the invention in use as a working platform with a sharp gradient and adjusted step inclination, and with folded-out supports and connecting rods.
Figure 4:
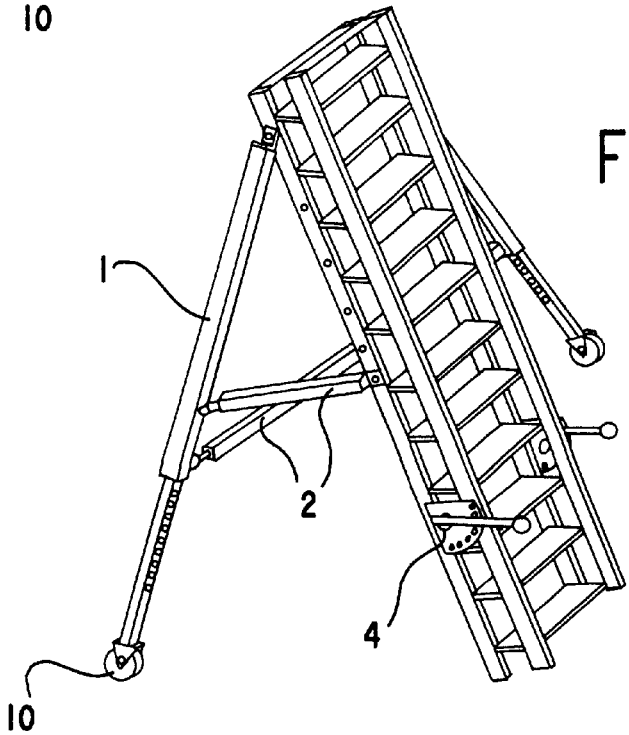
FIG. 4 is a perspective view of a multi-purpose scaffold of the invention in use as a freestanding double stepladder.

Referring now to the figures of the drawings in detail and first, particularly to FIGS. 3 and 4 thereof, there are shown freestanding or supported working platforms with a flat movement surface 7. The platforms can be used as a supported staircase (FIG. 3) or a freestanding double stepladder (FIG. 4) at any desired angle of support. Alternatively, the supported staircase or double stepladder can be converted into an ascending ramp by folding in the steps, without changing the angle of support or the position of the staircase or stepladder.

Using a lifting and sliding apparatus 4, step inclination is adjusted and locked from the movement side or top by raising and sliding the front sides of the steps. The steps can also be completely folded in or adjusted and locked at any desired angle of inclination from the movement side or top side only, independently of supports, struts, end fixing members, end lower bearing surfaces, or changes of position of the lower rail at any desired angle of support of the multi-purpose scaffold used as a staircase. A further advantage, for example, is that the multi-purpose scaffold can initially be laid on bearing points at different heights in order for a decision then to be made as to whether or not the steps have to be folded out (FIG. 4) or whether the multi-purpose scaffold is to be used as an ascending ramp or as a slide (FIG. 3). The step inclination can be adjusted as desired and locked without changing the position or lifting the multi-purpose scaffold. Retractable and extensible access apertures at the ends of the scaffold allow convenient access to the movement side when the multi-purpose scaffold is raised.

Figure 2:
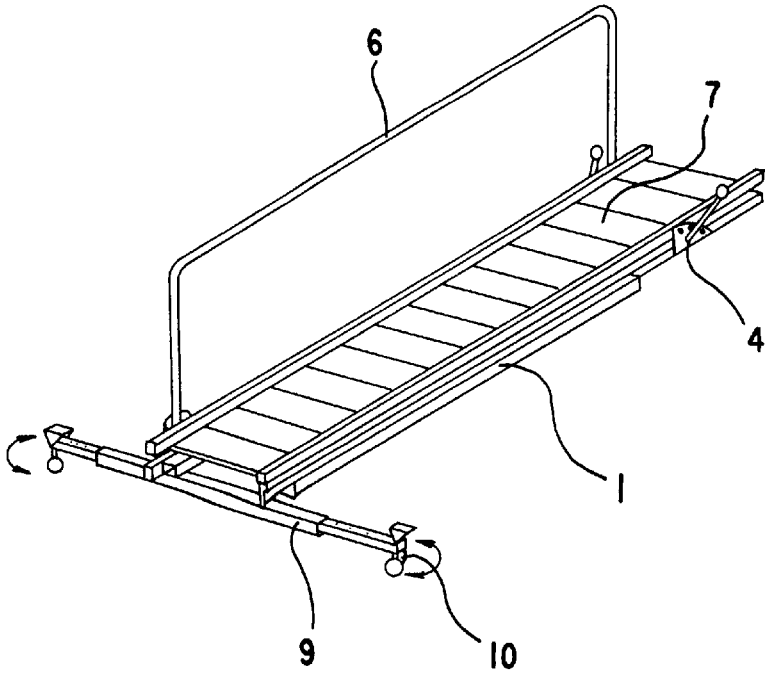
FIG. 2 is a perspective view of a multi-purpose scaffold of the invention with folded-in steps, folded-in supports, plug-in railings and extended rails as an anti-tilting safety device.

Using the multi-purpose scaffold as a catwalk (FIG. 2) or as a supported staircase requires anti-tilting protective devices 9 formed by telescopic or extensible rails 9 and attached transversely to the longitudinal or movement direction of the multi-purpose scaffold. Supporting bars 1 articulated on the long sides are telescopic and are provided at the foot ends with fold-in and fold-out rollers 10 (FIGS. 2 and 4) or footboards 10 (FIG. 3). The standing or splayed position of the support bars 1 is secured with telescopic connecting rods 2. The support bars 1, connecting rods 2 and extensible rails 9 do not affect the adjustment of the steps in the folded-out or folded-in state, as they are fixed to or articulated on the lower rails (FIGS. 2, 3, 4). The multi-purpose scaffold lower rail also does not need to be moved or raised in order to permit a change in the step inclination. The adjustment and locking of the step inclination, up to the complete folding of the steps 7 in a single plane takes place exclusively by lifting and sliding apparatuses 4 that are equipped with lockable lever bars. An extensible or fold-in climb-through aperture 5 can be provided at the lower rails because the lower rail can remain in the absolute position of rest during the adjustment of the step inclination and no influence is exerted on the steps or rails even at the end of the multi-purpose scaffold.

The outer sides of the multi-purpose scaffold each have two superposed rails (FIGS. 1 to 4). Between the rails are stair steps 7 disposed in sequence that, in the folded-in state, form a flat movement surface 7.

The fronts of the stair steps are connected in an articulated manner to the lower outside of the upper rail, and the backs of the steps are attached in an articulated manner to the upper outside of the lower rail (FIGS. 3 and 4).

Lifting and sliding apparatuses 4 are fixed to the two outer long sides of the lower rails and are connected in a moveable or articulated manner to the upper rails. Lever bars with locks are fixed to the lifting and sliding apparatuses 4.

By raising or lowering the lever bars, different step angles of inclination can be set without movement of the lower rail. In order to allow unobstructed setting of the steps from the top of the multi-purpose scaffold, the telescopic or extensible rails 9 are attached to the lower side transversely to the direction of movement as an anti-tilting safety device (FIG. 2). Fold-in and fold-out rollers are located at the free ends of the telescopic rails 9 of the anti-tilting safety device.

Similarly, support bars 1 are fixed in an articulated manner to the long sides of the lower rails (FIGS. 2 to 4). The support bars 1 are telescopic and also have fold-in and fold-out rollers 10 (FIG. 4) or fold-in and fold-out pivotable footboards 10 (FIG. 3). Fixed and telescopic connecting bars 2 secure the standing or splayed position of the support bars 1.

Extension sections 3 are provided for connecting two of the multi-purpose scaffolds together as shown in FIG. 1. Any one of adjustable suspension apparatuses, anti-slip devices, running rollers, or castors and jacket tubes on the rail parts can be used for receiving the extension sections 3 to connect a lower end of a first scaffold to an upper end of a different second scaffold, for example.

I claim:

1. A multi-purpose scaffold, comprising:

two ladder rail parts disposed adjacent one another and displaceable relative to one another;

displaceable steps adjustable along a step angle and disposed between said two ladder rail parts;

at least two fold-out splayed supporting poles connected to said two ladder rail parts;

at least one connecting rod connected to said at least two supporting poles for securing said at least two supporting poles; and a locking device for releasably locking said steps along the step angle and releasably locking said two ladder rail parts in different positions such that different step angles are determined independent of a position angle of said at least two rail parts relative to a bearing surface selected during use.

2. The multi-purpose scaffold according to claim 1, wherein each of said at least two supporting poles have lower ends and including at least two rollers connected to a respective one of said lower ends of said at least two supporting poles.

3. The multi-purpose scaffold according to claim 1, wherein each of said at least two supporting poles have lower ends and including at least two pivotable footboards each connected to a respective one of said lower ends of said at least two supporting poles.

4. The multi-purpose scaffold according to claim 1, wherein each of said at least two supporting poles is adjustably telescopic.

5. The multi-purpose scaffold according to claim 1, wherein said at least one connecting rod is adjustably telescopic.

6. The multi-purpose scaffold according to claim 1, wherein said at least two supporting poles adjustably fold in and out from said two ladder rail parts and releasably lock into a plurality of positions.

7. The multi-purpose scaffold according to claim 1, wherein said at least one connecting rod adjustably folds in and out from said two ladder rail parts and releasably locks into a plurality of positions.

8. The multi-purpose scaffold according to claim 1, including an extensible, folding and removable climb-through aperture.

9. The multi-purpose scaffold according to claim 1, including a removable railing attached to one of said two ladder rail parts as an anti-falling safety device.

10. The multi-purpose scaffold according to claim 9, wherein said removable railing is foldable.

11. The multi-purpose scaffold according to claim 9, wherein said removable railing is extensible.

12. The multi-purpose scaffold according to claim 1, including two removable railings each attached to a respective one of said two ladder rail parts as an anti-falling safety device.

13. The multi-purpose scaffold according to claim 12, wherein said two removable railings are foldable.

14. The multi-purpose scaffold according to claim 12, wherein said two removable railings are extensible.

15. The multi-purpose scaffold according to claim 1, wherein each of said two ladder rail parts has a lower end and an upper end forming a pair of lower ends and a pair of upper ends and including extension sections and one of the group consisting of adjustable suspension apparatuses, anti-slip devices, running rollers and castors and jacket tubes for receiving said extension section to connect at least one of said pair of lower ends and said pair of upper ends to a second multi-purpose scaffold.

16. The multi-purpose scaffold according to claim 1, wherein each of said two ladder rail parts has a lower end and an upper end forming a pair of lower ends and a pair of upper ends and including two telescopic rails fixed transverse to a movement direction of the scaffold to at least one of said pair of lower ends and said pair of upper ends as an anti-tilting safety device for using the scaffold as a freely resting plank.

17. The multi-purpose scaffold according to claim 16, wherein said telescopic rail has two telescopic ends.

18. The multi-purpose scaffold according to claim 17, wherein each of said two telescopic ends has a castor.

19. The multi-purpose scaffold according to claim 1, wherein each of said two ladder rail parts has a lower end and an upper end forming a pair of lower ends and a pair of upper ends and including two telescopic rails respectively fixed transverse to a movement direction of the scaffold to said pair of lower ends and said pair of upper ends as an anti-tilting safety device for using the scaffold as a freely resting plank.

20. The multi-purpose scaffold according to claim 1, wherein each of said two ladder rail parts are bifurcated into a lower rail part and an upper rail part.

* * * * *